US005765318A

United States Patent [19]

Michelsen

[11] Patent Number: 5,765,318

[45] Date of Patent: Jun. 16, 1998

[54] SEGMENTED, ENCAPSULATED INSULATION ASSEMBLY

[75] Inventor: Theodore W. Michelsen, Lakewood, Colo.

[73] Assignee: Johns Manville International, Inc., Denver, Colo.

[21] Appl. No.: 796,826

[22] Filed: Feb. 6, 1997

[51] Int. Cl.[6] ..... E04B 1/80; E04B 2/30; E04B 3/10

[52] U.S. Cl. ..... 52/98; 52/99; 52/100; 52/309.9; 52/309.14; 52/406.2; 428/43; 428/74; 428/77

[58] Field of Search ..... 52/98–100, 406.1, 52/406.2, 309.9, 309.14; 428/43, 74, 77

[56] References Cited

U.S. PATENT DOCUMENTS

| | | | |
|---|---|---|---|
| 1,238,356 | 8/1917 | Stokes | 428/43 |
| 3,488,248 | 1/1970 | Long | 428/43 |
| 3,812,002 | 5/1974 | Lurie | 428/43 |
| 4,627,995 | 12/1986 | Botsolas | 428/43 |
| 4,866,905 | 9/1989 | Bihy . | |
| 5,099,629 | 3/1992 | Gay | 428/43 X |
| 5,277,955 | 1/1994 | Schelhorn et al. . | |
| 5,545,453 | 8/1996 | Grant | 52/406.2 X |
| 5,547,725 | 8/1996 | Barrows et al. | 428/43 |

FOREIGN PATENT DOCUMENTS

| | | | |
|---|---|---|---|
| 347333 | 8/1960 | Switzerland | 52/406.2 |

*Primary Examiner*—Robert Canfield
*Attorney, Agent, or Firm*—Robert D. Touslee

[57] ABSTRACT

A segmented, encapsulated insulation assembly preferably includes a blanket of fibrous insulation having a plurality of longitudinally spaced apart, transversely extending cuts therein. The cuts divide the fibrous insulation into segments and weaken the fibrous insulation to permit the fibrous insulation to be selectively separated at any of the cuts. The fibrous insulation is encapsulated within an envelope having weakened transverse tear lines that divide the envelope into envelope segments. The transverse tear lines in the envelope overlay the cuts in the fibrous insulation to permit the envelope to be separated at the cuts thereby forming a plurality of encapsulated fibrous insulation modules. One or more of the encapsulated fibrous insulation modules can be selectively separated from the segmented, encapsulated fibrous insulation assembly to form an insulation panel of a desired length to insulate a cavity. Preferably, the surfaces of the fibrous insulation cuts are treated with a dust suppressant to reduce or prevent dust and/or fiber release from these surfaces.

22 Claims, 2 Drawing Sheets

SEGMENTED, ENCAPSULATED INSULATION ASSEMBLY

BACKGROUND OF THE INVENTION

The present invention relates to insulation for insulating odd length, generally short, wall, ceiling, floor and roof cavities and the like, and in particular, to a segmented or modularized, encapsulated insulation assembly for insulating such odd length cavities.

Building structures, such as homes, industrial buildings, office buildings, mobile homes, prefabricated buildings and similar structures typically include walls (both interior and exterior), ceilings, floors and roofs which are insulated for both thermal and acoustical purposes, especially the exterior walls and roofs of such structures. The walls, ceilings, floors and roofs of these structures include spaced-apart framing members, e.g. studs, rafters, joists, beams and similar support members, to which sheathing, paneling, lathing, wallboard or similar structural boarding or sheet materials are secured to form walls, ceilings, floors and roofs having cavities defined by the framing members and the boarding or sheet materials.

These cavities have standard dimensions, e.g. wall cavities in homes typically are about ninety three inches high or long by about fourteen or twenty two inches wide when framed with wooden studs or about fifteen or twenty three inches wide when framed with metal studs. The compressible and resilient fibrous batts of insulation typically used to insulate such cavities are typically about ninety six inches long by either fifteen or twenty three inches wide when insulating cavities framed with wooden studs or either sixteen or twenty four inches wide when insulating cavities framed with metal studs. The fibrous batts vary in thickness from about three and one half inches to about six and one half inches. Thus, when the fibrous batts are installed in such cavities, there is a friction fit between the batts and the side and end walls of the cavities to help hold the fibrous insulation batts in place. In ceilings, floors and roofs, the insulation batts are typically greater in thickness e.g. from about six and one half to about twenty four inches.

While many cavities have standard lengths or heights, many of the cavities, especially in walls and the like, are shortened by the inclusion of doorways, windows, skylights, ducts, vents, plumbing, electrical utilities and other structures or assemblies in or passing through the walls, ceilings, floors and roofs thereby forming odd length, generally relatively short, cavities in the walls, ceilings, floors and roofs which still require insulation.

When insulating these shortened, odd length cavities, it has been the practice to take a standard length fibrous insulation batt, e.g. a glass fiber insulation batt, and reduce the length of the batt by transversely cutting the fibrous batt at the job site. This method of fitting the standard size fibrous insulation batts to these shortened, odd length cavities at the job site is time consuming, creates scrap, raises safety issues with regard to the severing of the insulation batt, relies heavily on the workers' skill to accurately size the fibrous insulation batt to fit a particular cavity, can cause airborne dust and fibers, and requires extra handling of the fibrous insulation batt by the workers.

This practice is generally illustrated by U.S. Pat. No. 4,866,905; issued Sep. 19, 1989; to Bihy et al. The '905 patent discloses a continuous strip of unencapsulated, fibrous insulation with transverse marking lines to guide the workers when cutting the fibrous insulation at the job site. The workers, following the marking lines, cut the strips of fibrous insulation with a knife or similar means at the job site to a width somewhat greater than the spacing between the framing members of the cavity to be insulated and place the fibrous insulation in the cavity. As installed, the width of the roll of fibrous insulation becomes the length of the fibrous insulation.

Fibrous insulation assemblies are also known wherein a fibrous insulation batt is encapsulated within an envelope, such as a polymeric film, to confine dust and loose fibers within the insulation assemblies and provide relatively smooth, non-irritating outer surfaces on the insulation assemblies for handling. One such insulation assembly is disclosed in U.S. Pat. No. 5,277,955; issued Jan. 11, 1994; to Schelhorn et al. However, like the unencapsulated fibrous batts discussed above, fitting one of these standard size encapsulated fibrous insulation assemblies into a shortened, odd length cavity by cutting through the envelope and the fibrous insulation material, is time consuming, creates scrap, raises safety issues with regard to the severing of the envelope and insulation batt, relies heavily on the workers' skill to accurately size the fibrous insulation batt to fit a particular cavity, and requires extra handling of the fibrous insulation batt by the workers. Furthermore, by cutting open the envelope and cutting through the fibrous insulation batt at the job site, dust and loose fibers resulting from the cutting of the fibrous insulation batt could be irritating to the workers thereby defeating one of the purposes of encapsulating the fibrous insulation batt within the polymeric envelope.

SUMMARY OF THE INVENTION

The present invention provides an insulation assembly for insulating both standard and nonstandard length wall, ceiling, floor and roof cavities and especially, shortened, odd length wall cavities, with insulation materials, such as bonded, unbonded or binderless fibrous insulation batts or blankets and other fibrous, foam or similar insulation materials without exposing the workers to unnecessary dust and/or loose fibers from the insulation material caused by cutting the insulation material at the job site.

Preferably, the segmented or modularized, encapsulated fibrous insulation assembly of the present invention includes a blanket of fibrous insulation having a plurality of longitudinally spaced apart, transversely extending cuts therein. The cuts divide the blanket into segments and weaken the blanket to permit the blanket to be selectively separated at any of the cuts. The blanket is encapsulated within an envelope having weakened transverse tear lines that divide the envelope into envelope segments. The transverse tear lines in the envelope overlay and are aligned with the blanket cuts to permit the envelope to be separated at the cuts thereby forming a plurality of encapsulated fibrous insulation modules which are joined together to form a segmented, encapsulated fibrous insulation assembly.

When the length of insulation required to insulate a cavity is determined, one or more of the encapsulated fibrous insulation modules can be selectively separated from the remaining encapsulated fibrous insulation modules, preferably, by merely pulling or tearing apart adjacent encapsulated fibrous insulation modules of the segmented, fibrous insulation assembly. The blanket of the segmented, fibrous insulation assembly is preferably treated with a dust suppressant during the manufacturing process to reduce or prevent dust and/or fiber release from the blanket. Thus, by forming the cuts in the blanket during the manufacturing process, an appropriately sized encapsulated insulation panel of one or more modules is quickly and easily formed at a job site while creating little or no dust or loose fibers. The time consuming and scrap creating process of cutting entirely through fibrous insulation blankets at the job site is eliminated and accurately sized insulation panels for both standard and nonstandard length, especially shortened, odd length cavities, can be quickly and easily formed by relatively unskilled labor.

While fibrous insulation materials such as mineral fiber (e.g. glass fiber) or polymeric fiber batts or blankets are the preferred insulation material used in the segmented, encapsulated insulation assembly of the present invention, foam insulation materials can also be used in the segmented, encapsulated insulation assembly of the present invention.

DESCRIPTION OF THE PREFERRED EMBODIMENTS

Figure 1:
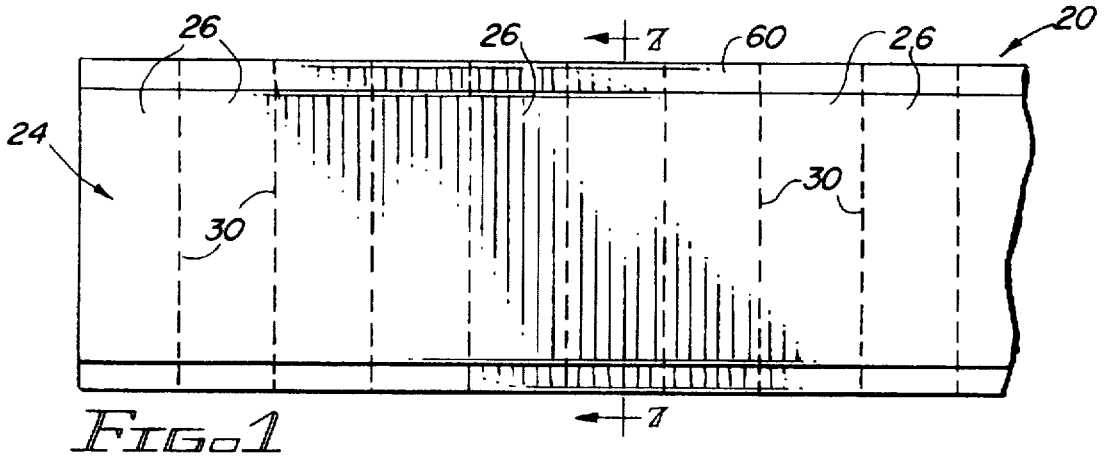
FIG. 1 is a plan view of the segmented, encapsulated insulation assembly of the present invention.
Figure 2:
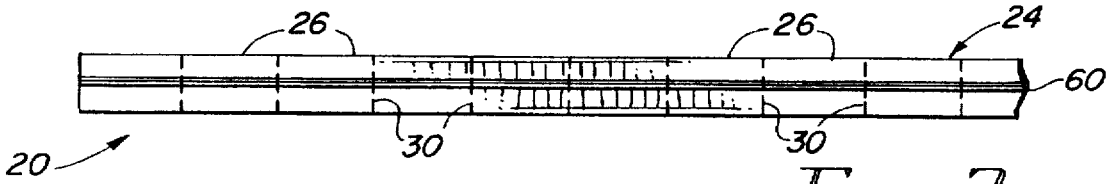
FIG. 2 is a side view of the segmented, encapsulated insulation assembly of FIG. 1.
Figure 3:
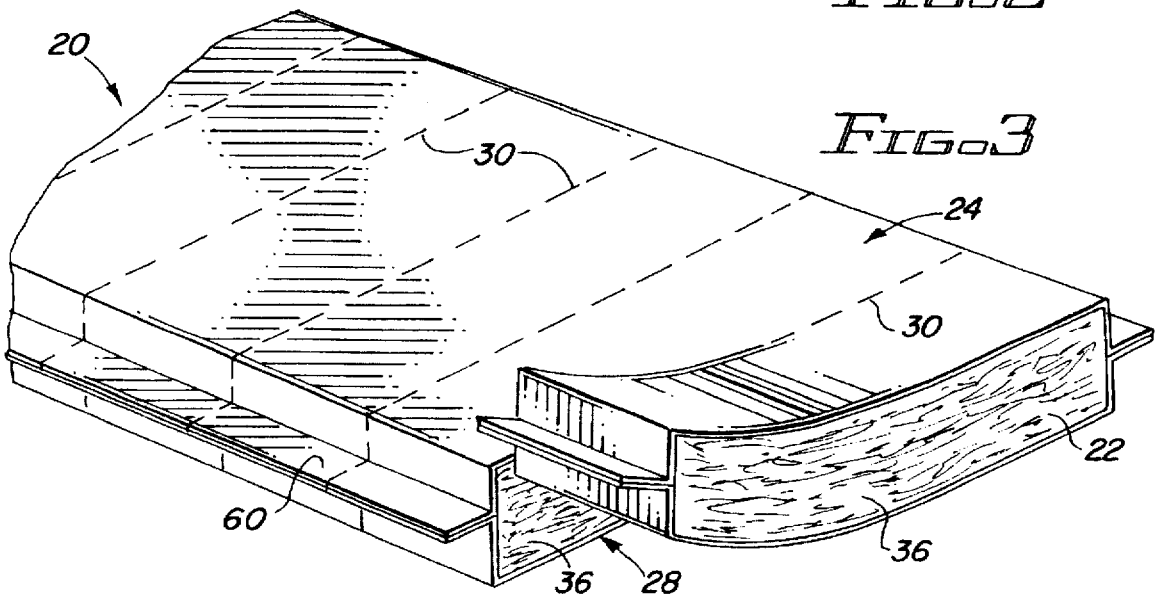
FIG. 3 is a perspective view of the segmented, encapsulated insulation assembly of the present invention showing one of the encapsulated insulation modules partially removed.

FIGS. 1–3 show a segmented, encapsulated insulation assembly 20 of the present invention. The segmented, encapsulated insulation assembly 20 includes an insulation material 22 and an envelope 24 encapsulating the insulation material 22.

The insulation material 22 is a fibrous, foam or similar insulation material, but preferably, the insulation material is a fibrous insulation material, such as conventional glass fiber building insulation that is both compressible and resilient. Where a fibrous batt or blanket is used as the insulation material 22, such as a glass or other mineral fiber batt or blanket or a polymeric fiber batt or blanket, the fibers of these batts or blankets may be bonded together with a binder, by heat bonding or by other means to give the batt or blanket integrity and resilience (hereinafter referred to as "bonded fibrous insulation material"). These batts or blankets can also be binderless or essentially binderless with the fibers of these batts or blankets being held together mainly by fiber entanglement alone (hereinafter referred to as "unbonded fibrous insulation material"). The unbonded fibrous insulation material is generally less resilient than the bonded fibrous insulation material. In addition to the preferred fibrous insulation materials, the insulation material 22 can also be a polymeric foam insulation material which is preferably both compressible and resilient.

Preferably, the envelope 24 is pliable and made of a thin polymeric film, such as polyethylene which may be metalized; kraft paper, nonwoven fabric, laminates of such materials or similar sheet materials. The envelope of the segmented, encapsulated insulation assembly can also be faced with one sheet material on one major surface and another sheet material on the remaining surfaces, e.g. kraft paper on one major surface and polymeric film on the sides and the other major surface. A preferred thin polymeric film used for forming the envelope 24 is an air permeable or impermeable, pliable film, such as but not limited to a polyethylene film about 0.1 to about 1.5 mils thick which may be metalized. By encapsulating the insulation material 22 of the segmented, encapsulated insulation assembly 20 within an envelope 24, dust and/or loose fibers or particles from the insulation material formed during the manufacture, encapsulating, packaging, shipping, handling and installation of the segmented, encapsulated insulation assembly 20 are contained within the envelope and do not become a possible irritant to the workers handling and installing the insulation assemblies.

As shown in FIGS. 1–3, the segmented, encapsulated insulation assembly 20 is divided or segmented into a series of segments or modules 26 which, preferably, are each between about six and about sixteen inches long and most preferably, about twelve inches long. The encapsulated insulation modules 26 are formed by at least partially cutting or severing the insulation material 22 transversely (perpendicular to the longitudinal centerline of the insulation material) to form transverse cuts 28 every six to sixteen inches along the length of the insulation material and by providing transverse tear lines 30 in the envelope 24 which overlay and are aligned with the cuts 28 in the insulation material 22.

Figure 7A:
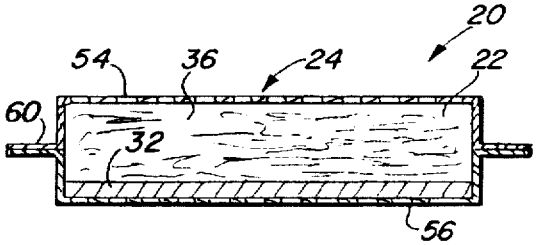
FIG. 7A is a transverse view of one form of the cut in the insulation material of the segmented, encapsulated insulation assembly taken substantially along lines 7—7 of FIG. 1.
Figure 7B:
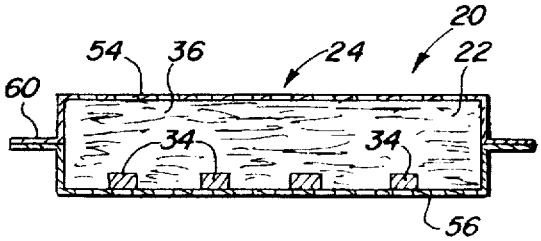
FIG. 7B is a transverse view of another form of the cut in the insulation material of the segmented, encapsulated insulation assembly taken substantially along lines 7—7 of FIG. 1.

FIGS. 7A and 7B show typical cuts formed in the insulation material 22 of the segmented, encapsulated insulation assembly 20 to form the encapsulated insulation modules 26. In FIG. 7A, the cut has a substantially uniform depth, passing almost entirely through the thickness of the insulation material 22, but leaving a narrow connecting strip 32 of insulation material, e.g. about ¼ to ½ of an inch thick, adjacent one major surface of the insulation material. In FIG. 7B, the cut passes entirely through the thickness of the insulation material 22 in transversely spaced apart locations to leave several narrow connecting strips 34 of insulation material adjacent one major surface of the insulation material. Preferably, the connecting strip 32 or connecting strips 34 permit adjacent segments of the insulation material 22 to be easily separated by merely pulling the segments apart thereby eliminating the need to use a knife or other means to cut the segments apart.

While the insulation material 22 can be completely cut or severed to form the encapsulated insulation modules 26, it is preferred to provide the encapsulated insulation modules with connecting strips, such as connecting strips 32 or 34, to connect adjacent modules of the segmented, encapsulated insulation assembly 20 and thereby make the segmented, encapsulated insulation assembly easier to handle. With the encapsulated insulation modules joined together by the connecting strips, the segmented, encapsulated insulation assembly 20 is easier to handle prior to and during installation of the assemblies and when separating one or more encapsulated insulation modules 26 from the remainder of a segmented, encapsulated insulation assembly for installation.

The transverse tear lines 30 in the envelope 24 are provided to facilitate the quick and easy separation of the envelope 24 at the locations of the cuts 28 in the insulation material 22. The tear lines 30 can be perforated lines in the envelope, as shown in FIGS. 1–3, or the tear lines can comprise other means of weakening or facilitating the separation of the envelope at these spaced apart locations overlaying the cuts 28, such as, but not limited to, weakened score lines or tear strips provided in the envelope material.

Preferably, the surfaces 36 of the cuts 28 are treated or coated with a dust suppressant such as but not limited to oil or phenolic resin or other binder materials. The treating or coating of the surfaces 36 with a dust suppressant reduces the possibility that dust or fibers from a fibrous insulation material will be released upon separating one or more encapsulated insulation modules 26 from a segmented, encapsulated insulation assembly 20 for installation. When a dust suppressant is used in the fibrous insulation material 22, preferably, the dust suppressant is applied to the fibers (e.g. sprayed onto the fibers) of fibrous insulation blanket 42 as the fibers are collected to form the blanket 42 so that the dust suppressant is substantially homogeneously distributed or present throughout the blanket 42 when the cuts 28 are formed during the manufacturing process. However, the dust suppressant can also be applied to the surfaces 36 of the cuts 28 (e.g. sprayed onto the surfaces) as or after the cuts 28 are formed in the blanket 42 or the dust suppressant can be applied to the fibers during the formation of the blanket 42 and to the cuts 28 in the blanket 42 as or after the cuts 28 are formed in the blanket 42.

With its segmented or modularized construction, the segmented, encapsulated insulation assembly 20 of the present invention can be used to insulate cavities having standard lengths or nonstandard lengths. Preferably, the segmented, encapsulated insulation assemblies 20, excluding the tabs 60, have a standard or nominal width of about fifteen, sixteen, twenty three or twenty four inches. Preferably, the segmented, encapsulated insulation assemblies 20 have standard or nominal thicknesses of about three and one half inches or greater and have thermal insulating characteristics or R values of about 11 or greater. In batt form the segmented, encapsulated insulation assembly 20 is typically about forty eight or ninety six inches long. In roll blanket form, the segmented, encapsulated insulation assembly 20 can be any desired length.

Figure 6:
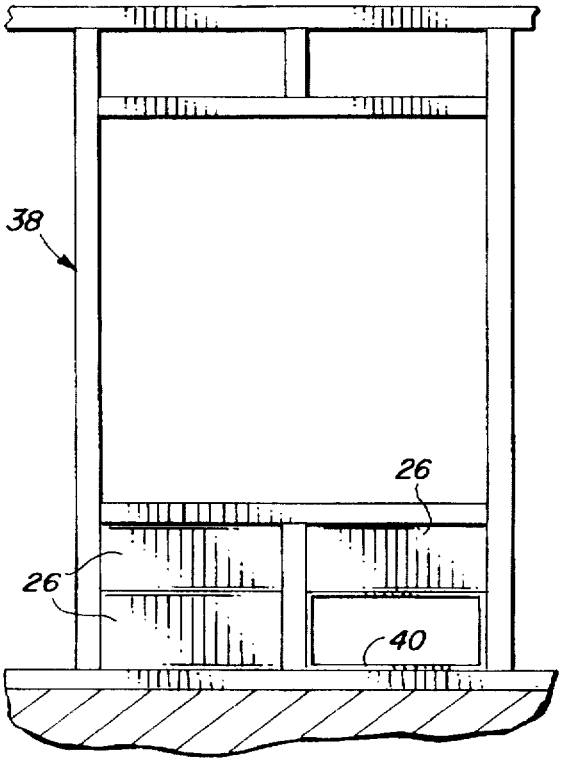
FIG. 6 is a fragmentary elevation of a wall structure showing modules of the segmented, encapsulated insulation assembly installed in odd length cavities of the wall structure.

By having the encapsulated insulation modules 26 between about six and about sixteen inches long and preferably, about twelve inches long one or more of the encapsulated insulation modules 26 can be separated from a segmented, encapsulated insulation assembly 20 to insulate short, odd sized cavities such as the ones shown in FIG. 6. FIG. 6 shows a wall section with a window frame 38, the portion of the wall below the window frame is insulated with the encapsulated insulation modules 26 of the present invention. The cavity on the left is insulated with two encapsulated insulation modules 26 and the cavity on the right, which has a duct 40 passing therethrough, is insulated with one encapsulated insulation module 26.

With the cuts 28 in the insulation material 22 and the weakened tear lines 24 in the envelope overlaying the cuts 28, one or more encapsulated insulation modules 26 and be easily and quickly separated from a segmented, encapsulated insulation assembly 20 to insulate odd length cavities. FIG. 3 shows an encapsulated insulation module 26 partially separated from a segmented, encapsulated insulation assembly 20. With a dust suppressant on the surfaces 36 of the cuts 28, the possibility of any dust or fiber release from the encapsulated insulation modules 26 is greatly reduced.

Figure 5:
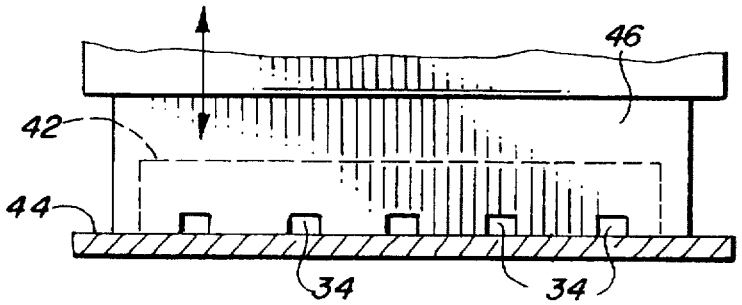
FIG. 5 is a view, taken substantially along lines 5—5 of FIG. 4, showing one type of chopping blade which can be used in the formation of the segmented, encapsulated insulation assemblies of the present invention.
Figure 4:
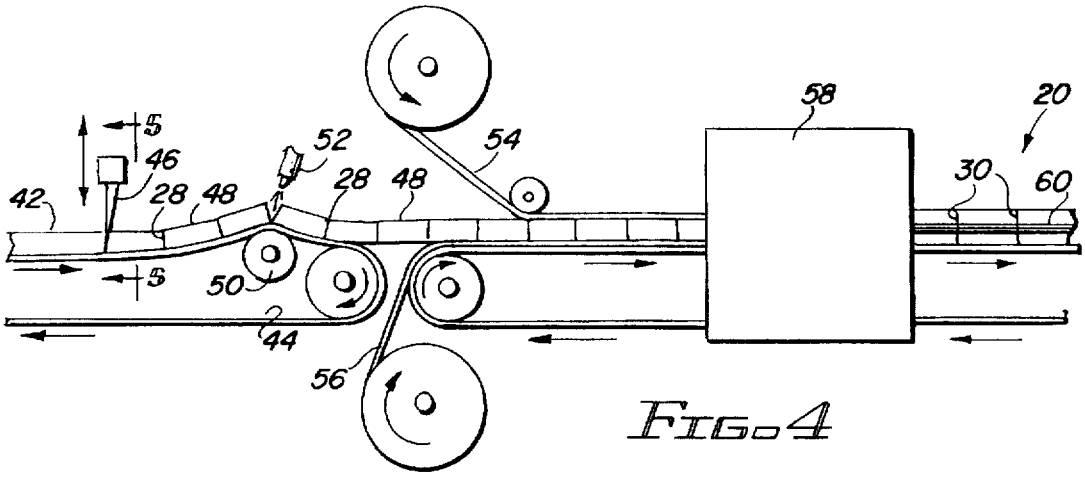
FIG. 4 is a side schematic view of a production line for forming the segmented, encapsulated insulation assemblies of the present invention.

FIGS. 4 and 5 schematically illustrate an apparatus and a method of forming the segmented, encapsulated insulation assembly 20 of the present invention. As shown, a fibrous insulation blanket 42 (with or without a dust suppressant therein) is conveyed along a conveyor 44 where it is periodically chopped by a chopping blade 46, such as the one shown in FIG. 5 which leaves a series of connecting strips 34 adjacent one major surface of the insulation blanket. As the blanket is chopped, it is segmented into a series of insulation material segments 48 preferably having lengths between about six inches and about sixteen inches long. Typically, all of the insulation material segments 48 have the same length, e.g. all of the segments can be twelve inches long, eight inches long or some other selected length between about six inches and about sixteen inches. However, the insulation material segments 48 can be varied in length, by varying the timing of the chopping cycle, e.g. having alternate segments twelve inches long and intermediate segments eight inches long.

After the fibrous insulation blanket 42 has been cut, the surfaces 36 of the cuts 28 may be treated or coated with a dust suppressant to reduce the possible release of dust or fibers from the surfaces 36 of the insulation material segments 48, especially if the blanket 42 has not been pretreated with a dust suppressant pre-applied throughout the blanket 42 during the collection of the fibers to form the blanket 42. As shown in FIG. 4, after the transverse cuts 28 are formed in the fibrous insulation blanket 42, the blanket is passed over a roller 50 which causes the cuts 28 to open as they pass over the roller. As the cuts open, the surfaces 36 of the transverse cuts 28 can be sprayed with a dust suppressant by a set of spray nozzles 52 extending transversely across the conveyor 44.

The segmented fibrous insulation blanket 42 is next passed through a facing station where, as shown, sheets 54 and 56 of a facing material(s), e.g. polyethylene films, are laid over and under the segmented fibrous insulation blanket 42. The sheets 54 and 56 of facing material(s) are provided with transverse, weakened tear lines 30 which are spaced apart along the lengths of the sheets 54 and 56 distances that correspond to the spacings between the transverse cuts 28 in the fibrous insulation blanket 42. The sheets 54 and 56 are brought into contact with the fibrous insulation blanket 42 with the transverse weakened tear lines 30 overlaying and in alignment with the transverse cuts 28 in the fibrous insulation blanket 42. The segmented, fibrous insulation blanket 42 and the sheets are then passed through a sealing station 58 which seals the upper and lower sheets 54 and 56 together at tabs 60 by heat welding or sealing, adhesive bonding or other conventional means to form the sheets 54 and 56 into the sealed envelope 24 that encapsulates the fibrous insulation blanket 42.

Figure 8:
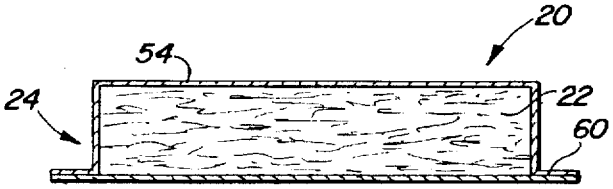
FIG. 8 is a transverse section of an embodiment of the present invention wherein the tabs joining the upper and lower sheets of facing materials are located in the plane of one of the major surfaces of the segmented, encapsulated insulation module.

While the tabs 60 joining the upper and lower facing sheets 54 and 56 in FIGS. 1–3 and 7A and 7B are located in a plane extending parallel to and about midway between the major faces of the segmented, encapsulated insulation assemblies 20, the tabs can also be located in or substantially in the plane of one of the major surfaces of the segmented insulation module 20 as shown in FIG. 8.

While the insulation material 22 used in this example is a fibrous insulation blanket, other insulation materials, such as polymeric foam insulation materials that are preferably compressible and resilient, could be formed into the segmented, encapsulated insulation assembly 20 by the same basic method and apparatus. While FIGS. 4 and 5 schematically show one method and apparatus for forming the segmented, encapsulated insulation assembly 20 of the present invention, the segmented, encapsulated insulation assembly 20 can be formed with other conventional apparatus and by other conventional methods well known in the industry. In addition, instead of using two facing sheets 54 and 56 to form the envelope 24, the envelope 24 can be made by using only a single sheet of facing material which is wrapped and sealed about the insulation material 22 or a tubular sheet of facing material into which the segmented insulation material is inserted.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A segmented, encapsulated insulation assembly comprising:

an insulation material having a length, a width and a thickness; said insulation material having a plurality of longitudinally spaced apart, transversely extending cuts therein, dividing said insulation material into insulation segments and weakening said insulation material to facilitate separation of said insulation material at said cuts; and said insulation material being encapsulated within an envelope; said envelope having weakened transverse tear lines that divide said envelope into envelope segments and overlay said cuts to permit said envelope to be separated at said cuts whereby one or more of said insulation segments, encapsulated in said envelope segments, can be separated from said segmented, encapsulated insulation assembly; wherein said transversely extending cuts extend for the entire width of said insulation material and for substantially the entire thickness of said insulation material leaving adjacent insulation segments joined by a portion of said insulation material adjacent a major surface of said insulation material.

2. The segmented, encapsulated insulation assembly according to claim 1, wherein: surfaces of said transversely extending cuts have a dust suppressant thereon.

3. The segmented, encapsulated insulation assembly according to claim 2, wherein: said weakened transverse tear lines are perforated lines.

4. The segmented, encapsulated insulation assembly according to claim 3, wherein said insulation segments and said envelope segments range from about six to about sixteen inches long.

5. The segmented, encapsulated insulation assembly according to claim 4, wherein: said insulation material is a fibrous insulation material.

6. The segmented, encapsulated insulation assembly according to claim 5, wherein: said dust suppressant is present substantially throughout said fibrous insulation material.

7. The segmented, encapsulated insulation assembly according to claim 4, wherein: said insulation material is a foam insulation material.

8. A segmented, encapsulated fibrous insulation assembly comprising:

a compressible and resilient blanket of fibrous insulation having a length, a width and a thickness; said blanket having a plurality of longitudinally spaced apart, transversely extending cuts therein, dividing said blanket into blanket segments and weakening said blanket to facilitate separation of said blanket at said cuts; and said blanket being encapsulated within a pliable envelope; said envelope having weakened transverse tear lines that divide said envelope into envelope segments and overlay said cuts to permit said envelope to be separated at said cuts whereby one or more of said blanket segments encapsulated in said envelope segments can be separated from said segmented, encapsulated fibrous insulation; wherein said transversely extending cuts extend for the entire width of said blanket and for substantially the entire thickness of said blanket leaving adjacent blanket segments joined by a blanket portion adjacent a major surface of said blanket.

9. The segmented, encapsulated fibrous insulation assembly according to claim 8, wherein: surfaces of said transversely extending cuts have a dust suppressant thereon.

10. The segmented, encapsulated fibrous insulation assembly according to claim 9, wherein: said dust suppressant is present substantially throughout said fibrous insulation.

11. The segmented, encapsulated fibrous insulation assembly according to claim 9, wherein: said weakened transverse tear lines are perforated lines.

12. The segmented, encapsulated fibrous insulation assembly according to claim 11, wherein said blanket segments and said envelope segments range from about six to about sixteen inches long.

13. The segmented, encapsulated fibrous insulation assembly according to claim 8, wherein said blanket segments and said envelope segments range from about six to about sixteen inches long.

14. The segmented, encapsulated fibrous insulation assembly according to claim 8, wherein: said transversely extending cuts extend for the entire width of said blanket and for substantially the entire thickness of said blanket leaving adjacent blanket segments joined at said transversely extending cuts by transversely spaced apart blanket portions located adjacent one major surface of said blanket.

15. The segmented, encapsulated fibrous insulation assembly according to claim 8, wherein: said envelope is a polymeric film and said weakened transverse tear lines are perforated lines.

16. The segmented, encapsulated fibrous insulation assembly according to claim 8, wherein: said fibrous blanket comprises glass fibers.

17. The segmented, encapsulated fibrous insulation assembly according to claim 16, wherein: said fibrous blanket is a bonded fibrous blanket.

18. The segmented, encapsulated fibrous insulation assembly according to claim 17, wherein: surfaces of said transversely extending cuts have a dust suppressant thereon.

19. The segmented, encapsulated fibrous insulation assembly according to claim 18, wherein: said dust suppressant is present substantially throughout said fibrous insulation.

20. The segmented, encapsulated fibrous insulation assembly according to claim 16, wherein: said fibrous blanket is an unbonded fibrous blanket.

21. The segmented, encapsulated fibrous insulation assembly according to claim 20, wherein: surfaces of said transversely extending cuts have a dust suppressant thereon.

22. The segmented, encapsulated fibrous insulation assembly according to claim 21, wherein: said dust suppressant is present substantially throughout said fibrous insulation.

* * * * *